US005197162A

United States Patent [19]

Pinto et al.

[11] Patent Number: 5,197,162

[45] Date of Patent: Mar. 30, 1993

[54] APPARATUS HAVING PARTIAL EXHAUST CONDUIT FIBER COMPACTING AIR FLOW

[75] Inventors: Akiva Pinto, Duesseldorf-Wittlaer; Guenter Lucassen, Haltern, both of Fed. Rep. of Germany

[73] Assignee: Hergeth Hollingsworth GmbH, Fed. Rep. of Germany

[21] Appl. No.: 768,846

[22] PCT Filed: Apr. 10, 1990

[86] PCT No.: PCT/EP90/00568

§ 371 Date: Oct. 7, 1991

§ 102(e) Date: Oct. 7, 1991

[87] PCT Pub. No.: WO90/12909

PCT Pub. Date: Nov. 1, 1990

[30] Foreign Application Priority Data

Apr. 17, 1989 [DE] Fed. Rep. of Germany ..... 3912565

[51] Int. Cl.[5] ..... D01G 15/40; D01G 23/02

[52] U.S. Cl. ..... 19/105; 406/70; 406/106; 406/171

[58] Field of Search ..... 19/65 A, 97.5, 105, 19/106 R, 204, 205, 200, 240, 296, 300, 304; 222/52, 55, 57, 564; 406/12, 70, 106, 171, 181; 137/8, 561 A, 563; 138/39; 209/28, 29, 132, 138, 143

[56] References Cited

U.S. PATENT DOCUMENTS

| | | | |
|---|---|---|---|
| 4,136,911 | 1/1979 | Husges et al. | 19/105 X |
| 4,154,485 | 5/1979 | Lytton et al. | 406/70 |
| 4,176,988 | 12/1979 | Lattman et al. | 406/171 |
| 4,219,289 | 8/1980 | Trüzscher | 19/105 X |
| 4,387,486 | 6/1983 | Keller et al. | 19/105 |
| 4,394,790 | 7/1983 | Keller et al. | 19/105 |
| 4,403,374 | 9/1983 | Wood | 19/105 |
| 4,404,710 | 9/1983 | Wood | 19/105 |
| 4,476,611 | 10/1984 | Keller et al. | 19/105 |
| 4,510,647 | 3/1985 | Keller et al. | 19/105 |
| 4,520,530 | 6/1985 | Pinto | 19/105 |
| 4,657,444 | 3/1987 | Pinto | 19/105 X |
| 4,694,538 | 9/1987 | Pinto et al. | 19/105 |
| 4,779,311 | 10/1988 | Leifeld | 19/105 |
| 4,970,759 | 11/1990 | Roberson | 19/105 |
| 5,005,261 | 3/1991 | Pinto et al. | 19/105 |

FOREIGN PATENT DOCUMENTS

| | | | |
|---|---|---|---|
| 1020326 | 1/1989 | Japan | 19/105 |
| 3130420 | 6/1991 | Japan | 19/105 |
| 2104560 | 3/1983 | United Kingdom | 19/105 |

*Primary Examiner*—Andrew M. Falik
*Assistant Examiner*—Ismael Izaguirre
*Attorney, Agent, or Firm*—Cort Flint

[57] ABSTRACT

In a device for feeding flocculent fiber material to processing machines, comprising an upper filling chute (1) arranged in a housing, at the lower end of which a feeding roller (8) is arranged cooperating with a beater or opening roller (9) from which a feeding chute (6) branches tangentially, the filling chute (1) and the feeding chute (6) having at least one at least partially air-permeable chute wall (2, 11), an additional pneumatic compacting being performed in the feeding chute by injecting a compacting air flow (C), and the flow of transport air (A) being discharged at the air-permeable chute wall (2) of the filling chute (1), it is provided that the flow of transport air (A) is discharged within the housing (7) into an exhaust air chute (3, 4) that is substantially parallel to the filling and feeding chute (1, 6) to an exhaust air connecting member (5) arranged downstream of the air-permeable chute wall (11), and that a partial air flow (B) of the flow of transport air (A) is supplied into the feeding chute (6) as the flow of compacting air (C) at a branching point between the filling chute (1) and the feeding chute (6), and that the flow of compacting air (D) escaping from the air-permeable chute wall (11) of the feeding chute (6) is guided into the exhaust air chute (4) downstream of the branching point.

4 Claims, 1 Drawing Sheet

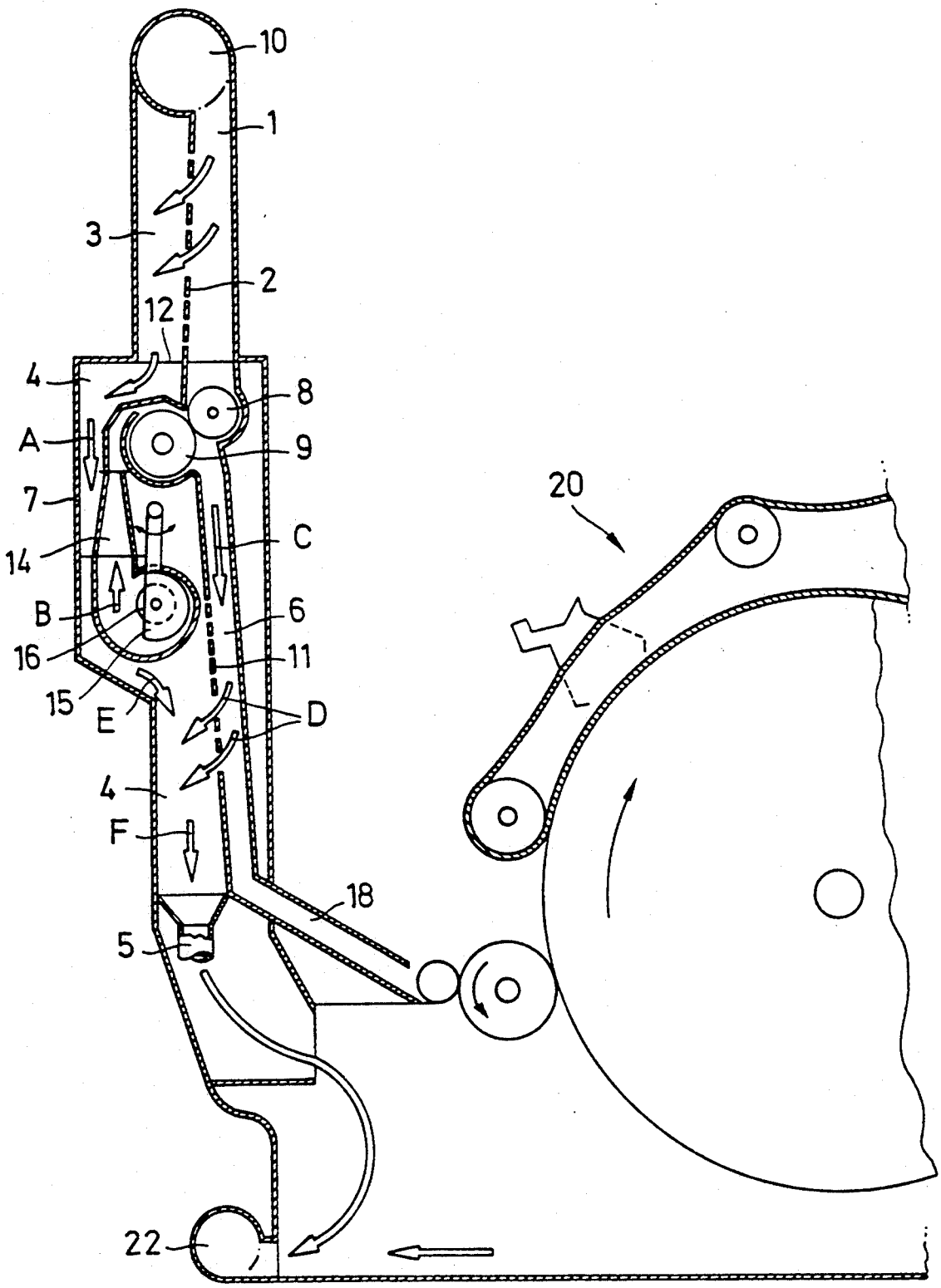
10
1
3
2
12
4
8
A
9
7
20
14
C
B
6
16
11
15
E
D
4
F
18
5
22

APPARATUS HAVING PARTIAL EXHAUST CONDUIT FIBER COMPACTING AIR FLOW

BACKGROUND OF THE INVENTION

1. Field of the Invention

The invention relates to a device for feeding flocculent fiber material to processing machines.

Such feeding devices are used for example with carding machines, but also with opening and cleaning machines.

2. Description of the Related Art

A known device for feeding machines that process fiber material, e.g. carding machines, beating machines or the like, is disclosed for example in German Laid Open 36 25 311. The feeding device has an upper filling chute with perforated walls from which the flow of transport air may be discharged. A feeding roller cooperating with a beater or an opening roller is arranged at the lower end of the filling chute. Tangentially from the beater roller, a feeding chute also having partly perforated chute walls leads to a pair feed rollers supplying the fiber mat to the next processing machine. Tangential to the beater roll, but behind the beating point, a compacting air flow is blown into the chute that escapes at the perforated chute walls of the feeding chute and is supplied to a fan for recirculation.

The flow of transport air escaping at the upper feeding chute is discharged via a separate exhaust conduit. A such feeding device only allows to compact the fibers in the feeding chute, but does not contribute to a reduction of the dust accompanying cotton fiber flocks.

It is the object of the invention to improve the feeding device of the type initially mentioned such that the amount of dust in the fiber flocks is reduced.

SUMMARY OF THE INVENTION

The flow of transport air is advantageously discharged within the housing in an exhaust chute that is substantially parallel to the filling and feeding chute to an exhaust air connecting member at the lower end of the machine. This exhaust air connecting member is arranged downstream of the air-permeable chute wall of the feeding chute and is thus able to additionally discharge the flow of compacting air separated from the fibers, which is particularly rich in dust and foreign particles after the beating point between the feeding and the beater roller. A part of the transport air flow discharged from the filling chute is used as the flow of compacting air, the branching point being arranged downstream of the air-permeable chute wall of the filling chute, but before the air-permeable chute wall of the feeding chute. In this way, it is guaranteed that only the flow of transport air separated in the filling chute is used as the flow of compacting air.

The entire flow of exhaust air may be connected with an exhaust air outlet of e.g. the next machine via the exhaust air connecting member arranged in the lower portion of the machine.

Preferably, the branched part of the air flow is directed to the nip between the feeding and the beater rollers in a tangential direction with respect to the beater roller, whereby, advantageously, the branched part of the air flow is not only used as the compacting air flow, but the blowing effect thereof also supports the loosening of dust and foreign particles from the fiber flocks at the beating point in the nip. The compacting air flow enriched by waste and dust particles is not recirculated, but discharged directly via the exhaust chute.

The partial air flow may alternately be shut-off or released, thereby causing a pump effect in the feeding chute that permits a self-cleaning effect at the air-permeable chute wall of the feeding chute, thus preventing a clogging of the air-permeable chute wall, e.g. a sieve wall, and allowing an unobstructed continuous operation.

Downstream of the air-permeable chute wall of the filling chute, the exhaust air chute may be adapted to be at least partially shut off intermittently. In this way one may also obtain a self-cleaning effect at the air-permeable chute wall in the filling chute. The shut-off operation may be effected by means of slides or flaps that may also be subdivided over the width of the chute and may be operated alternately.

DESCRIPTION OF THE DRAWINGS

The construction designed to carry out the invention will hereinafter be described, together with other features thereof.

The invention will be more readily understood from a reading of the following specification and by reference to the accompanying drawings forming a part thereof, wherein an example of the invention is shown and wherein:

The FIGURE is a partial side sectional view of a feeding device for a carding machine including the air ducting of the invention.

DESCRIPTION OF A PREFERRED EMBODIMENT

The following is a detailed description of the present invention taken in conjunction with the only drawing.

The FIGURE illustrates a feeding device for a carding machine, the air ducting being also suited for the feed opening of an opening and cleaning machine. The flocculent fiber material is supplied to an upper filling chute 1 via a transport channel 10, the chute being connected via an air-permeable chute wall 2 with an exhaust air chamber 3 that forms a part of an exhaust air chute 4 that is substantially parallel to the filling chute 1 and the feeding chute 6. Exhaust air chute 4 is arranged therebelow and extends from the exhaust air chamber 3 into the lower portion of the machine to an exhaust air connecting member 5. This exhaust air chute 4 is arranged within the housing 7 of the feeding device.

A feeding roller 8 is arranged at the lower end of the filling chute 1, cooperating with a beater and opening roller 9 from which the feeding chute 6 branches tangentially. The feeding chute 6 also has an at least partially air-permeable chute wall 11 that is also open to the exhaust air chute 4. The lower end of the exhaust air chamber 3 is provided with shut off flaps or slides 12 that may be intermittently opened or closed, thereby causing a pump effect in the filling chute that prevents a clogging of the air-permeable intermediate wall 2. The shut-off flaps and slides 12 may also be controlled to release only a part of the chute width, respectively. In the portion of the exhaust chute 4 below the filling chute 1, a fan 14 is disposed that branches a partial air flow B from the flow of transport air A and supplies this partial air flow to the nip between the feeding roller 8 and the beater roller 9 in a direction tangential to the beater roller. A pulsating injection of the partial air flow B is possible through a pivotable slide 15 that intermittently closes or releases the suction opening 16 of the fan 14. The partial air flow B is illustrated in the feeding chute 6 behind the beating point. The compacting air flow C which passes into the exhaust air chute 4 at the lower portion of the feeding chute 6 through the air-permeable chute wall 11 of the feeding chute 6, is illustrated by the arrows D. In the exhaust air chute 4, the partial air flow mixes with the flow of transport air E, less the partial air flow B, and is discharged as exhaust air F via the exhaust air connecting member 5.

The feeding chute 6 is slighty inclined by approximately 10° with respect to the vertical plane through the feeding roller 8 and passes into a chute slide 18 without draw-off rollers. The fiber mat is supplied to a carding machine 20 via chute slide 18. The exhaust air connecting member 5 may be connected to an exhaust air discharge 22 of the carding machine 20.

While a preferred embodiment of the invention has been described using specific terms, such description is for illustrative purposes only, and it is to be understood that changes and variations may be made without departing from the spirit or scope of the following claims.

What is claimed is:

1. A device for feeding flocculent fiber material to fiber processing machines, comprising an upper filling chute arranged within a housing, means for providing a fiber transport air flow in said device, a feeding roll adapted to cooperate with an opening roller at a lower end of said filling chute, a feeding chute branching tangentially from said opening roller, the filling cute and the feeding chute each having at least one at least partially air-permeable wall, means for providing a pneumatic fiber compacting air flow in the feeding chute, and said transport air flow being discharged through the air-permeable chute wall of the filling chute, wherein the flow of transport air (A) discharge within the housing (7) through said air-permeable filling chute wall thereafter being directed through an exhaust air chute (3,4), said exhaust air chute (3,4) being substantially parallel to and co-extensive with the filling and feeding chute (1,6) and substantially parallel to an exhaust air connecting member (5) for exhausting transport air from the device, said exhaust air connecting member (5) being arranged downstream of the air-permeable feeding chute wall (11);

transport air flow dividing means; and said compacting air flow (C) consisting of:

a partial air flow (B) being divided from the flow of transport air (A) by said flow dividing means, and means for directing said partial air flow into the feeding chute (6) at the branching point between the filling chute (1) and the feeding chute (6); and said compacting air flow thereafter passes through the air-permeable feeding chute wall (11) of the feeding chute (6 at D) and is guided into the exhaust air chute (4) downstream of the branching point.

2. The device according to claim 1, wherein the partial air flow (B) is directed onto a nip formed between the feeding roller (8) and the opening roller (9).

3. A device for feeding flocculent fiber material to fiber processing air-permeable feeding chute wall (11) of the feeding chute (6 at D) and is guided into the exhaust chute (4) downstream of the branching point; and an intermittently operating device for pulsating said partial air flow (B).

4. A device for feeding flocculent fiber processing material to fiber air-permeable feeding chute wall (11) of the feeding chute (6 at D) and is guided into the exhaust air chute (4) downstream of the branching point; and wherein the air flow through the exhaust air chute (4) is shut off at least intermittently downstream of the air-permeable chute wall (92) of the filling chute (1) by shut-off devices (12).

* * * * *